US008335444B2

(12) United States Patent
Shibuya

(10) Patent No.: US 8,335,444 B2
(45) Date of Patent: Dec. 18, 2012

(54) IMAGE FORMING APPARATUS

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 12/723,921

(22) Filed: Mar. 15, 2010

(65) Prior Publication Data

US 2010/0239287 A1 Sep. 23, 2010

(30) Foreign Application Priority Data

Mar. 17, 2009 (JP) ..... 2009-064985

(51) Int. Cl.
*G03G 15/02* (2006.01)

(52) U.S. Cl. ..... 399/50; 399/168

(58) Field of Classification Search ..... 399/50, 399/168

See application file for complete search history.

(56) References Cited

U.S. PATENT DOCUMENTS

| | | | |
|---|---|---|---|
| 6,477,342 | B2 | 11/2002 | Komiya et al. |
| 7,469,109 | B2 | 12/2008 | Shibuya |
| 7,778,560 | B2 | 8/2010 | Ishibashi et al. |
| 2007/0127939 | A1 | 6/2007 | Kitajima |
| 2007/0166063 | A1 | 7/2007 | Kitano |
| 2008/0031646 | A1 | 2/2008 | Ishibashi et al. |
| 2008/0304842 | A1 | 12/2008 | Tomiie |
| 2010/0008685 | A1 | 1/2010 | Shibuya |
| 2010/0278549 | A1 | 11/2010 | Ishibashi et al. |

FOREIGN PATENT DOCUMENTS

| | | | |
|---|---|---|---|
| CN | 101118400 | A | 2/2008 |
| JP | 2004-347751 | A | 12/2004 |
| JP | 2008216753 | A * | 9/2008 |

OTHER PUBLICATIONS

Notification of the First Office Action dated Aug. 10, 2011, in counterpart Chinese Application No. 201010135776.6.

Office Action dated Jul. 4, 2012, in Chinese Application No. 201010135776.6.

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes a rotatable photosensitive member; charging device for electrically charging the photosensitive member by being supplied with a charging bias; a current detecting device for detecting a DC current flowing when a test bias in the form of a predetermined DC voltage biased with a predetermined AC voltage is applied to the charging device so as to cause discharging between the photosensitive member and the charging device; and a control device for controlling the charging bias on the basis of an output of the current detecting device.

4 Claims, 13 Drawing Sheets

APPLIED DC VOL.VS.DRUM POTENTIAL

PEAK-TO-PEAK VOL.VS. CHRG POTENTIAL
(23°C/50%RH;APPLIED DC:-500V)

PEAK-TO-PEAK VOL.VS. DC CRNT
(23°C/50%RH;APPLIED DC:-500V)

PEAK-TO-PEAK VOL.VS. CHRG POTENTIAL(PRE EXP. : ON)
(23°C/50%RH;APPLIED DC:-500V)

PEAK-TO-PEAK VOL.VS. DC CRNT(PRE EXP. : ON)
(23°C/50%RH;APPLIED DC:-500V)

DC CRNT VS.DRUM POTENTIAL

DC VOLTAGE VS. DC CURRENT

CHARGE CYCLE VS. CONTACT ANGLE

NUMBER OF SHEETS VS. CHARE POTENTIAL

IMAGE FORMING APPARATUS

FIELD OF THE INVENTION AND RELATED ART

The present invention relates to an image forming apparatus including a charging device for electrically charging a photosensitive member.

In recent years, in an image forming apparatus of an electrophotographic type, in order to electrically charge the photosensitive member, a method in which a charging member of a roller type or a blade type is brought into contact with the photosensitive member to charge the photosensitive member has been used. In order to charge the photosensitive member by this contact charging method, two methods are well known. One is an AC (alternating current) charging method for charging the photosensitive member by applying a superposed voltage of a DC (direct current) voltage and an AC voltage to a charging member, and the other is a DC charging method for charging the photosensitive member by applying only the DC voltage to the charging member. In the AC charging method, the AC voltage is applied, so that compared with the DC charging method, it is possible to relatively uniformly charge the photosensitive member surface.

On the other hand, in the AC charging method, compared with the DC charging method, an amount of electric discharge with respect to the photosensitive member is increased and therefore the surface of the photosensitive member is liable to be abraded. For that reason, when the photosensitive member is charged by the AC charging method, a lifetime of the photosensitive member is shortened compared with the case where the photosensitive member is charged by the DC charging method. In this way, the DC charging method has the advantage that it is possible to suppress the shortening of the lifetime and an amount of generation of electric discharge product. However, the DC charging method is inferior in uniformity of photosensitive member surface potential (charging uniformity) to the AC charging method. Specifically, in the AC charging method, the photosensitive member can be charged up to a DC voltage value by applying a charging bias in the form of a DC voltage biased (superposed) with an AC voltage having a peak-to-peak voltage which exceeds two times a discharge start voltage.

Here, in the DC charging method, the photosensitive member cannot be charged up to an applied DC voltage value (FIG. 6). Further, the DC voltage necessary to charge the photosensitive member to a desired potential varies depending on an environmental condition of the image forming apparatus, a material of a charging roller, variations in resistance during manufacturing, and a state of continuous image formation. For that reason, it was very difficult to control the DC voltage value to be applied to the charging roller.

Therefore, Japanese Laid-Open Patent Application (JP-A) 2004-347751 discloses a constitution in which a potential sensor for measuring a potential of the photosensitive member surface is provided in order that the surface potential of the photosensitive member is set at a desired value by the DC charging method. Specifically, in order that the potential of the photosensitive member is the desired potential, the DC voltage value to be applied to the charging roller is changed on the basis of a result of detection of the surface potential by the potential sensor.

In recent years, a compact image forming apparatus has been desired in the market. In order to make the image forming apparatus compact, it is necessary to decrease sizes of respective constituent elements and dispose the constituent elements at a high density. In order to make the image forming apparatus compact, it has been difficult to ensure a space for permitting measurement of the potential of the photosensitive member surface by the potential sensor. For example, when a diameter of a photosensitive drum (photosensitive member) is about 60 mm, it was possible to dispose, around the photosensitive member, the potential sensor in addition to a charging device, a developing device, a transfer device, and a cleaning blade. However, in the image forming apparatus using the photosensitive drum having a diameter of about 30 mm, the space in which the potential sensor was provided was not able to be ensured. For that reason, when the image forming apparatus employing the DC charging method capable of increasing the lifetime of the photosensitive member was made compact, the potential sensor was not disposed and therefore it was difficult to make the potential of the photosensitive member a desired potential.

SUMMARY OF THE INVENTION

A principal object of the present invention is to provide an image forming apparatus capable of electrically charging a photosensitive member to a desired potential (VD) by using the DC charging method without using a potential sensor.

According to an aspect of the present invention, there is provided an image forming apparatus comprising:

a rotatable photosensitive member;

charging means for electrically charging the photosensitive member by being supplied with a charging bias;

current detecting means for detecting a DC current flowing when a test bias in the form of a predetermined DC voltage biased with a predetermined AC voltage is applied to the charging means so as to cause discharging between the photosensitive member and the charging means; and control means for controlling the charging bias on the basis of an output of the current detecting means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the image forming apparatus according to the present invention will be described with reference to the drawings.

First, features of the AC charging method and the DC charging method will be described.

(AC Charging Method)

The AC charging method can realize uniform charging by applying an oscillating voltage to alternately cause electric discharge on a positive side and on a negative side.

For example, it has been known that the oscillating voltage in the form of the DC voltage (DC offset bias) biased with an AC voltage having a peak-to-peak voltage which is not less than two times a discharge start threshold voltage (charging start voltage) of a member to be charged when the DC voltage is applied. As a result, an effect that the charging of the member to be charged is uniformized can be achieved to realize the uniform charging.

A waveform of the oscillating voltage is not limited to a sinusoidal wave but may also be a rectangular wave, a triangular wave, or a pulse wave. Further, the oscillating voltage may include a voltage of the rectangular wave formed by periodically turning the DC voltage on and off, and a voltage providing the same output as that of a superposed voltage of the AC voltage and the DC voltage by periodically changing a value of the DC voltage.

Figure 16:
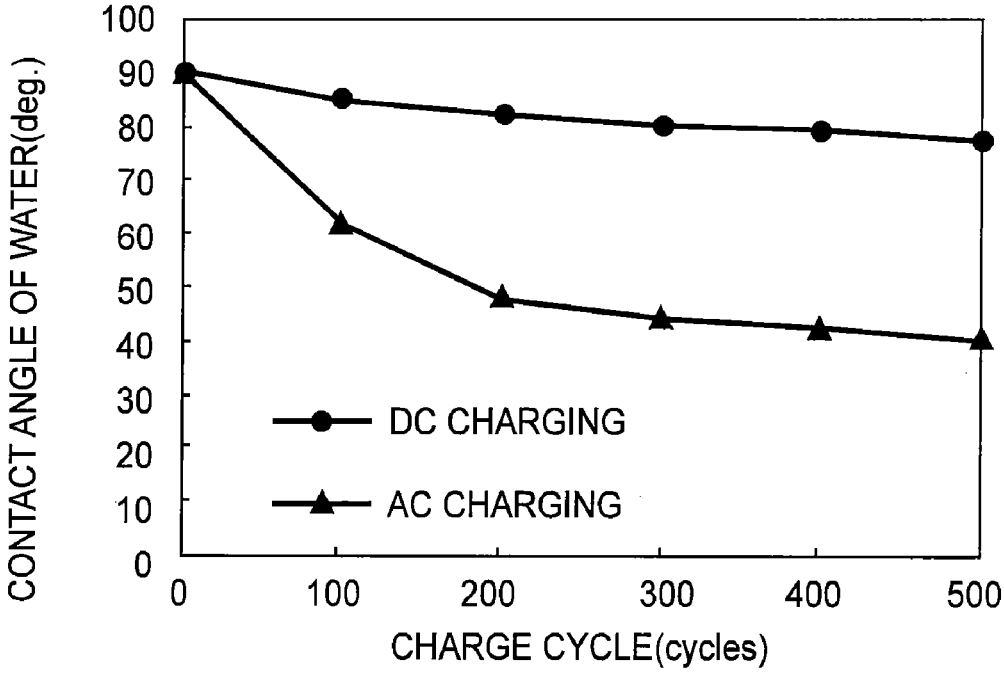
FIG. 16 is a graph showing an example of a relationship between the number of charge cycles and a contact angle of water at a photosensitive member surface in a conventional image forming apparatus.

However, in the AC charging method, compared with the DC charging method, an amount of electric discharge with respect to the photosensitive member is increased, so that a deterioration of the photosensitive member such as abrasion (wearing) of the photosensitive member is accelerated and also an abnormal image such as image flow by an electric discharge product in a high temperature and high humidity environment is caused to occur in some cases. FIG. 16 is a graph showing an example of a relationship between the number of charge times and a contact angle of water at a photosensitive member surface.

In the AC charging method, compared with the DC charging method, a degree of a lowering in contact angle of water at the photosensitive member surface is large. This is attributable to such a result that a degree of wattability of the photosensitive member surface with water is increased by the influence of the electric discharge product generated by the charging. That is in the AC charging method, a degree of a lowering in electric resistance at the photosensitive member is large compared with the case of the DC charging method.

(DC Charging Method)

Figure 6:
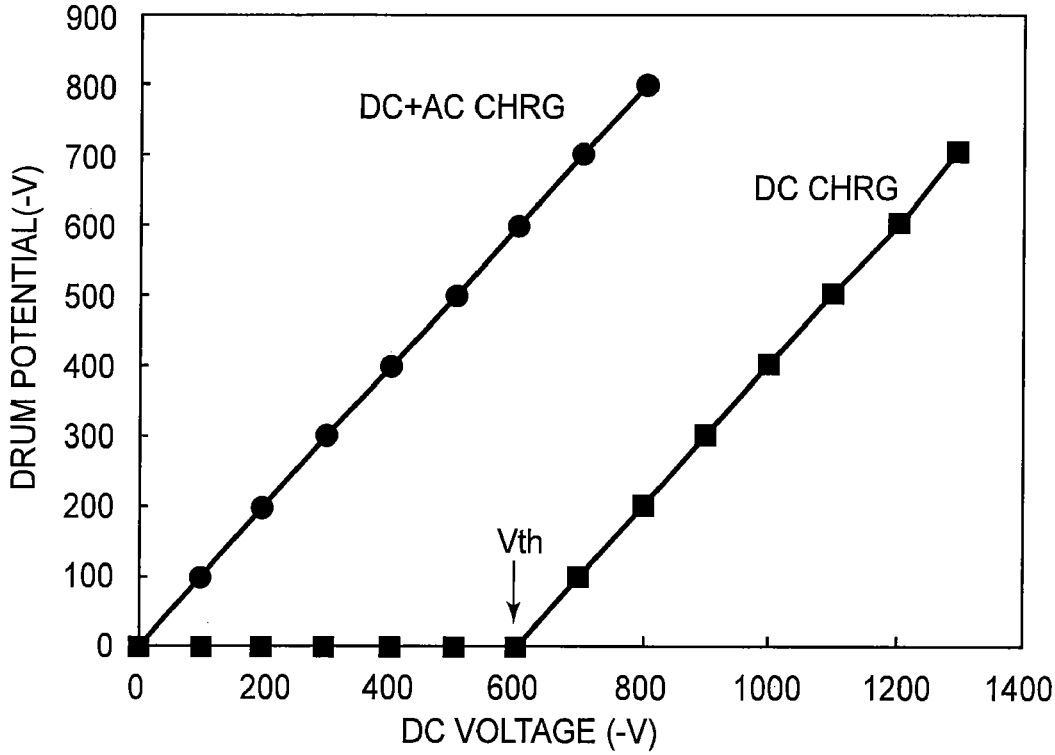
FIG. 6 is a graph showing a relationship between an applied DC voltage and a photosensitive member surface potential in Embodiment 1.
Figure 17:
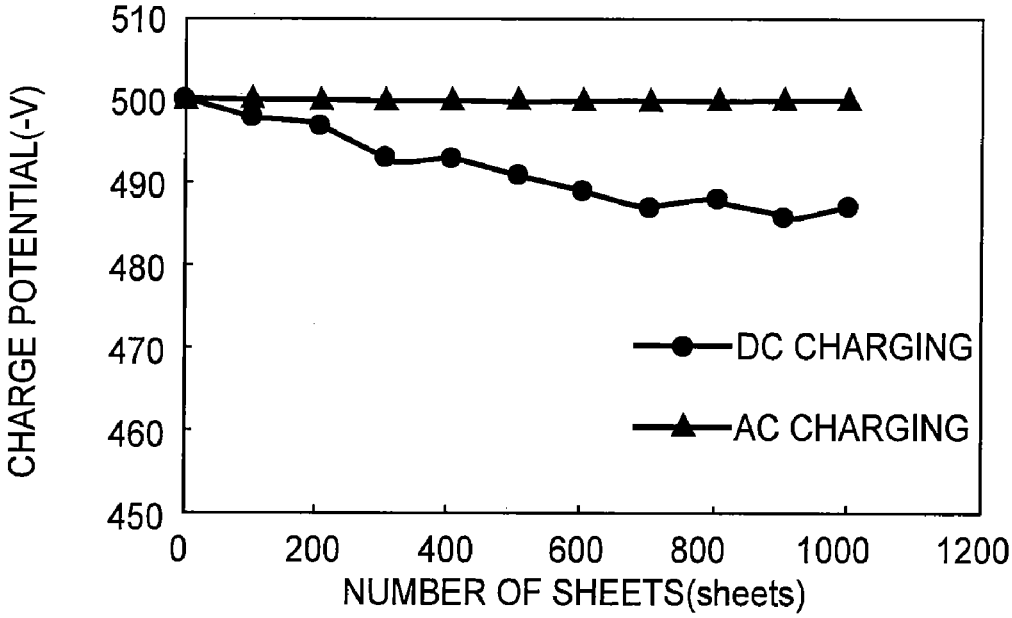
FIG. 17 is a graph showing an example of a relationship between the number of sheets subjected to continuous image formation and a charge potential in the conventional image forming apparatus.

AS shown in FIG. 6, in the AC charging method, a surface potential of the photosensitive member as the member to be charged is substantially equal to the applied DC voltage. On the other hand, in the DC charging method, the surface potential of the photosensitive member as the member to be charged is increased from the discharge start threshold value (Vth) in accordance with the Paschen's law, so that a convergence performance of the photosensitive member surface potential is inferior to that in the AC charging method. Particularly, in the case where there is a difference in electric resistance with respect to the charging member or the e photosensitive member, in the DC charging method, the difference in electric resistance results in a potential difference. When potential non-uniformity of a charge potential (Vd) is caused and exposure is effected with the same light amount, a developing contrast after the exposure also causes the potential difference. As a result, a problem of a difference in image density is caused. FIG. 17 is a graph showing a charge in photosensitive member surface potential with time when the same photosensitive member is charged by a contact charging member to have the charge potential of −500V in the DC charging method and in the AC charging method. Specifically, in the DC charging method, the DC voltage of −1100V was applied. In the AC charging method, the DC voltage of −500V and the AC voltage (peak-to-peak voltage) of 1600Vpp were applied. The change in surface potential with time was measured through continuous image formation after an initial charge potential was set at −500V in an electrophotographic image forming apparatus.

From the result of FIG. 17, it is understood that the charge potential of −500V is not changed with time in the AC charging method but is changed in the DC charging method when the applied bias set at the initial charge potential of −500V is continuously used. This is because the electric resistance of the photosensitive member or the contact charging member is increased during the continuous image formation and thus a charging performance is lowered in the DC charging method. In the AC charging method, the charge potential converged at the applied DC bias, so that the photosensitive member surface potential was kept at −500V. Thus, even when the initial charge potential can be set at a predetermined value, in the case of the DC charging method, it is difficult to keep the charged potential for a long term at the same applied DC bias.

Embodiment 1

1. General Structure of Image Forming Apparatus

Figure 1:
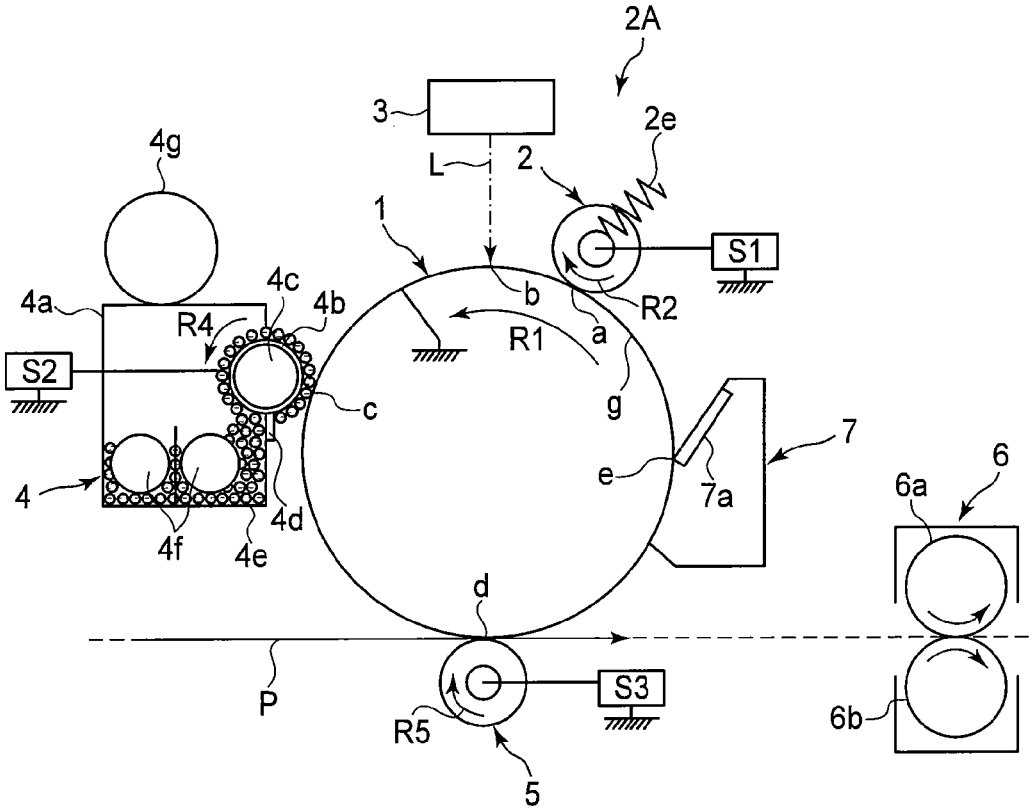
FIG. 1 is a schematic structural view of an image forming apparatus in Embodiment 1.

FIG. 1 is a schematic view for illustrating a general structure of the image forming apparatus. In this embodiment, the image forming apparatus is a laser beam printer which utilizes a transfer type electrophotographic process and is of a contact charging type and a reverse development type and which has an A3 size as a maximum sheet passing size.

In this embodiment, the image forming apparatus includes a rotatable drum-type electrophotographic photosensitive member 1 as a first image bearing member (hereinafter referred to as a photosensitive drum). Around the photosensitive drum 1, along a rotational direction (counterclockwise directions of the photosensitive drum 1, image process means including a charging device 2A characterizing the present invention are disposed. That is, the charging device (a roller charger) 2A provided with a charging roller 2 as a contact charging member, a developing device 4, a transfer roller 5 as a contact transfer member, and a cleaning device 7 are disposed. Above a space between the charging roller 2 and the developing device 4, an exposure device 3 is provided. Further, a fixing device 6 is provided on a downstream side of a transfer portion d, formed between the photosensitive drum 1 and the transfer roller 5, with respect to a transfer material conveying direction.

(Photosensitive Drum)

Figure 2:
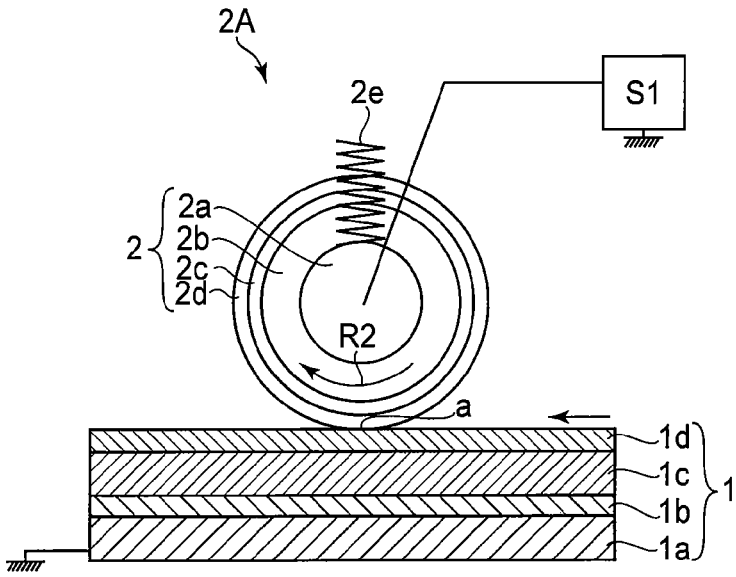
FIG. 2 is a schematic sectional view of layer structures of a photosensitive drum and a charging roller in the image forming apparatus in Embodiment 1.

The photosensitive drum 1 is a negatively chargeable organic photoconductor (OPC) photosensitive member having an outer diameter of 30 mm in this embodiment and is rotationally driven at a process speed (peripheral speed) of 210 mm/sec in a direction indicated by an arrow R1 (counterclockwise direction) by drive of a driving device (not shown). The photosensitive drum 1 is, as shown in FIG. 2, constituted by coating three layers consisting of an undercoat layer 1*b* for improving adhesiveness to upper layer while suppressing interference of light, a photocharge generating layer 1*c*, and a charge transporting layer 1*d* in this order on the surface of an aluminum-made cylinder (electroconductive drum substrate) 1*a*.

(Charging Device)

The charging roller 2 is rotatably held by shaft-supporting members (not shown) at both end portions of its core metal 2*a* and is disposed in contact with the surface of the photosensitive drum 1 by being urged toward a center direction of the photosensitive drum 1 by an urging spring 2*e*, thus press-contacting the photosensitive drum 1 with a predetermined urging force. Therefore, the charging roller 2 is rotated in a direction indicated by an arrow R2 by the rotational drive of the photosensitive drum 1. A press-contact portion between the photosensitive drum 1 and the charging roller 2 is a charge portion (charging nip) a. Incidentally, a position g shown in FIG. 1 is a position immediately before the charge portion.

To the core metal 2*a* of the charging roller 2, a charging bias voltage is applied from a power source S1 under a predetermined condition, so that the peripheral surface of the photosensitive drum 1 is contact-charged to a predetermined polarity and a predetermined potential. In this embodiment, the charging bias voltage applied to the charging roller 2 is only a DC bias during image formation and is combination of the DC bias and an AC bias as a test bias during control for determining a DC bias value during non-image formation. More specifically, by the DC bias, the peripheral surface of the photosensitive drum 1 is contact-charged uniformly to −500 V (dark potential: Vd). Further, a frequency of the AC applied during the control is 2 kHz.

Further, the charging roller 2 has a length of 320 mm with respect to its longitudinal direction. As shown in FIG. 2, the charging roller 2 has, around the core metal (supporting member) 2*a*, three-layer structure consisting of a lower layer 2*b*, an intermediary layer 2*c*, and a surface layer 2*d* which are successively laminated in this order. The lower layer 2*b* is a foam sponge layer for decreasing charging noise, and the surface layer 2*d* is a protective layer provided for preventing an occurrence of leakage even when a defect such as a pin hole is present on the photosensitive drum 1.

More specifically, the charging roller 2 in this embodiment has the following specification.

Core metal 2*a*: stainless steel rod with a diameter of 6 mm

Lower layer 2*b*: carbon-dispersed foam EPDM (specific gravity: 0.5 g/cm$^3$, volume resistivity: $10^2$-$10^9$ ohm·cm, layer thickness: 3.0 mm)

Intermediary layer 2*c*: carbon-dispersed NBR rubber (volume resistivity: $10^2$-$10^5$ ohm·cm, layer thickness: 700 μm)

Surface layer 2*d*: fluorinated "Torejin" resin in which tin oxide and carbon particles are disposed (volume resistivity: $10^7$-$10^{10}$ ohm·cm, surface roughness (JIS ten-point average surface roughness Ra): 1.5 μm, layer thickness: 10 μm)

(DC Current Value Measuring Circuit)

Figure 4:
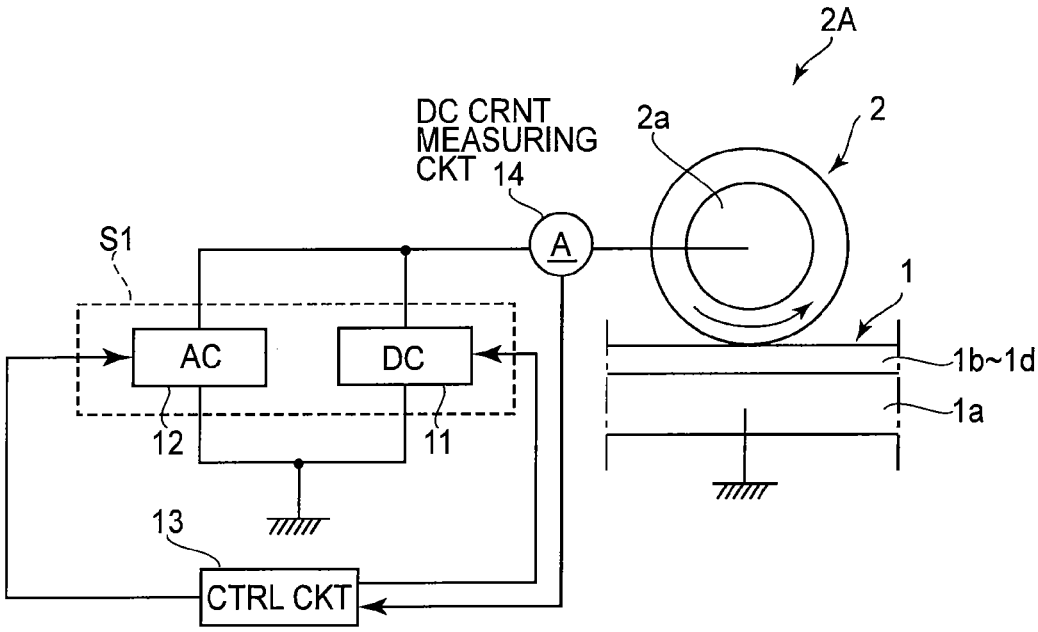
FIG. 4 is a block circuit diagram of a charging bias applying system.

As shown in a block diagram of FIG. 4, the image forming apparatus includes a DC current value measuring circuit 14 for measuring a value of DC current passing between the photosensitive drum 1 and the charging roller 2. In this embodiment, the DC current value measuring circuit 14 is provided between the power source S1 and the charging roller 2. As a result, the DC current value measuring circuit 14 can detect an amount of current flowing from the power source S1 to the charging roller 2. Incidentally, the DC current value measuring circuit 14 may only be required that it can measure the DC current value between the photosensitive drum 1 and the charging roller 2 and therefore may also be provided between the photosensitive drum 1 and the ground. A connection relationship between the DC current value measuring circuit and another circuit will be described layer.

(Other Members at Image Forming Portion)

The exposure device 3 is a laser beam scanner using a semiconductor laser in this embodiment. The laser beam scanner 3 outputs laser light (beam) modulated correspondingly to an image signal input from an unshown host processing device such as an image reading device and subjects the uniformly charged surface of the photosensitive drum 1 to scanning exposure (image exposure) to light L at an exposure position b. By this scanning exposure to light L, the potential of the surface of the photosensitive drum 1 which has been irradiated with the laser light L is lowered, so that an electrostatic latent image is successively formed on the photosensitive drum 1 surface correspondingly to image information obtained by the scanning exposure to light L.

The developing device 4 is a reverse-developing device of a two-component magnetic brush developing type in this embodiment and supplies toner to an exposed portion (light portion) of the photosensitive drum 1 surface. The toner is deposited on the electrostatic latent image, so that the electrostatic latent image is reversely developed (visualized). The developing device 4 includes a developing container 4*a*, a non-magnetic developing sleeve 4*b* provided at an opening of the developing container 4*a* and rotatable in a direction indicated by an arrow R4, and a fixed magnet roller 4*c* contained in the developing sleeve 4*b*. A developer (toner) 4*e* in the developing container 4*a* is coated in a thin layer on the developing sleeve 4*b* and is conveyed to a developing portion c where the developing sleeve 4*b* opposes the photosensitive drum 1. The developer 4*e* in the developing container 4*a* is a mixture of the toner and a magnetic carrier and is conveyed toward the developing sleeve 4*b* while being stirred uniformly by rotation of two developer-stirring members 4*f*. In this embodiment, the magnetic carrier has a resistivity of about $10^{13}$ ohm·cm and a particle size of 40 μm, and the toner is triboelectrically charged to a negative polarity by friction with the magnetic carrier. The toner content (concentration) in the developing container 4*a* is detected by a concentration sensor (not shown). On the basis of this detected information, the toner is supplied in an appropriate amount from a toner hopper 4*g* to the developing container 4*a*, so that the toner content is adjusted at a constant level.

The developing sleeve 4*b* is provided closely and oppositely to the photosensitive drum 1 while keeping the closest distance with respect to the photosensitive drum 1 at 300 μm at the developing portion c. At the developing portion c, the developing sleeve 4*b* is rotationally driven in a direction opposite from the rotational direction (counterclockwise direction) of the photosensitive drum 1. To the developing sleeve 4*b*, a predetermined bias voltage is applied from a power source S2. In this embodiment, the developing bias voltage applied to the developing sleeve 4*b* is an oscillating voltage in the form of a DC voltage (Vdc) biased with an AC voltage (Vac). More specifically, in this embodiment, the developing bias voltage is the oscillating voltage in the form of the DC voltage (−320 V) biased with the AC voltage (frequency: 8 kHz, peak-to-peak voltage: 1800 Vpp).

The transfer roller 5 press-contacts the photosensitive drum 1 with a predetermined urging force to form the transfer portion d and is rotatable in a direction indicated by an arrow R5. Further, to the transfer roller 5, a transfer bias (of a positive polarity opposite from the negative polarity as a normal charge polarity of the toner; +500 V in this embodiment) is applied. As a result, at the transfer portion d, a transfer image on the photosensitive drum 1 surface is transferred onto the transfer material P such as a sheet (paper) as a second image bearing member.

The fixing device 6 includes a fixing roller 6*a* and a pressing roller 6*b* which are rotatable in directions indicated by arrows, and heat-presses the toner image transferred on the surface of the transfer material P while nip-conveying the transfer material P at a fixing nip between the fixing roller 6*a* and the pressing roller 6*b*, thus heat-fixing the toner image.

The surface of the photosensitive drum 1 after the toner image transfer onto the transfer material P is rubbed with a cleaning blade 7*a* of the cleaning device 7 to be subjected to removal of untransferred toner therefrom, thus being cleaned. Then, the photosensitive drum 1 is subjected to image formation repeatedly. In FIG. 1, a reference symbol e represents a photosensitive drum surface press-contact portion of the cleaning blade 7*a*.

2. Operation Sequence of Image Forming Apparatus

Figure 3:
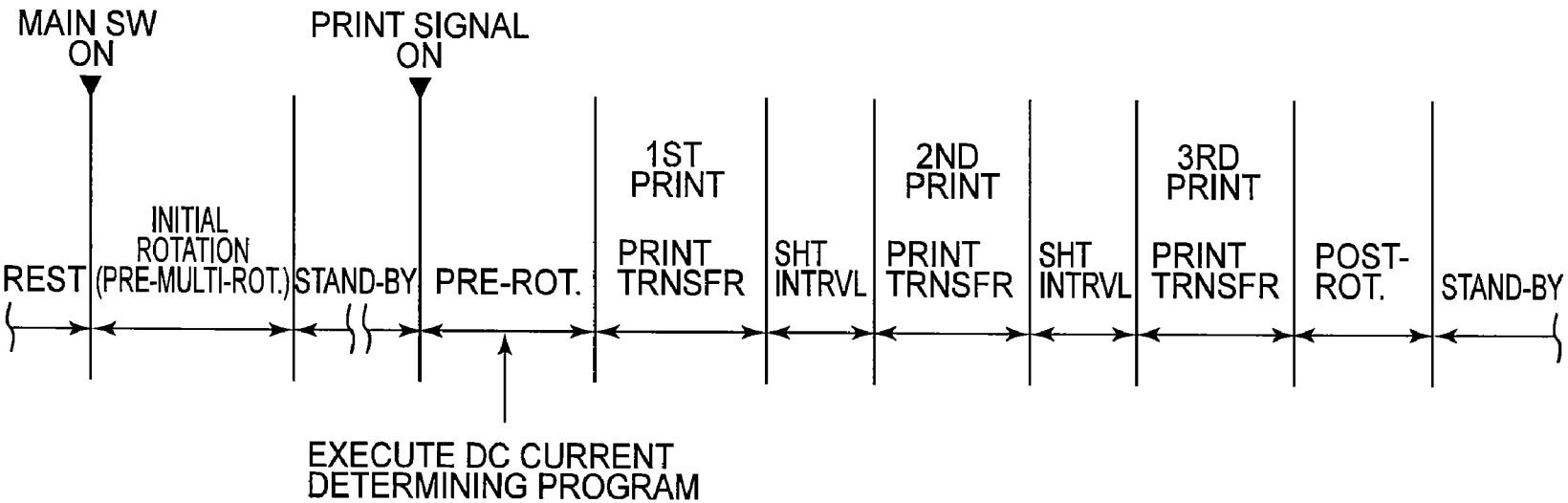
FIG. 3 is a sequence diagram for illustrating an operation of the image forming apparatus.

FIG. 3 shows an operation sequence of the above-described printer (image forming apparatus). The operation of the image forming apparatus will be described below with reference to FIG. 3.

a. Initial Rotation Operation (Pre-Multi-Rotation Step)

In an actuation operation period (warm-up period) during actuation of the printer, the photosensitive drum is rotationally driven by turning a (main) power switch on and preparatory operations of predetermined process devices (equipment) such as warm-up of the fixing device to a predetermined temperature are executed.

b. Preparatory Rotation Operation for Printing (Pre-Rotation Step)

In a preparatory rotation operation period, before image formation, from print signal input until an image forming (printing) step operation is actually performed, this operation is executed in succession to the initial rotation operation when the print signal is input during the initial rotation operation. When the print signal is not input, the drive of the main motor is once interrupted, after the initial rotation operation is completed, to stop the rotational drive of the photosensitive drum, so that the printer is kept in a stand-by (waiting) state until the print signal is input. When the print signal is input, the preparatory rotation operation for printing is executed. In this embodiment, in this preparatory rotation operation period for printing, an arithmetic computation and determination program for an applied DC bias value in a charging process in a printing step is executed. This will be described later more specifically.

c. Printing Step (Image Forming Step)

When the preparatory rotation operation for printing is completed, an image forming process with respect to the rotating photosensitive drum is carried out and then the toner image formed on the rotating photosensitive drum surface is transferred onto the transfer material and fixed by the fixing device, so that an image-formed product is printed out.

In the case of a continuous printing mode, the above-described printing step is repeatedly performed correspondingly to a pre-set number of sheets (n sheets).

d. Sheet Interval Step

This step corresponds to a non-sheet-passing state period from after a trailing end of a transfer material passes the transfer portion d until a leading end of a subsequent transfer material reaches the transfer portion d.

e. Post-Rotation Operation

In a predetermined period, the post-rotation operation is performed in a manner such that the main motor drive is continued for a time, even after the printing step for a final transfer material is completed, to rotationally drive the photosensitive drum, thus performing a predetermined post-operation.

f. Stand-by

When the predetermined post-operation is completed, the main motor drive is stopped to stop the rotational drive of the photosensitive drum and then the printer is kept in a stand-by state until a subsequent print start signal is input. In the case of printing on only one sheet, after completion of the printing, the printer is a stand-by state after completion of the post-rotation operation. In the stand-by state, when the print start signal is input, the printer goes to the pre-rotation step.

During the above-described c. Printing step corresponds to during image formation. Further, during the above-described a. Initial rotation operation, b. Preparatory rotation operation for printing, d. Sheet interval step, and e. Post-rotation operation corresponds to during non-image formation.

3. Block Diagram

FIG. 4 is a block diagram of a charging bias applying system with respect to the charging roller 2. The peripheral surface of the rotating photosensitive drum 1 is electrically charged to a predetermined potential by applying a DC voltage from the power source S1 to the charging roller 2 through the core metal 2*a*. Further, the peripheral surface of the rotating photosensitive drum 1 is electrically charged to a predetermined potential by applying a predetermined oscillating voltage in the form of a DC voltage biased with an AC voltage having a frequency f (i.e., bias voltage Vdc+Vac) from the power source S1 to the charging roller 2 through the core metal 2*a*. The power source S1 as a voltage applying means with respect to the charging roller 2 includes a DC power source 11 and an AC power source 12.

A control circuit 13 as a control means has the function of controlling the power source S1 so that the charging roller 2 is supplied with the DC voltage or the oscillating (superposed) voltage in the form of the DC voltage biased with the AC voltage by effecting ON/OFF control of the DC power source 11 and the AC power source 12. The control circuit 13 further has the function of controlling a value of the DC voltage to be applied from the DC power source 11 to the charging roller 2 and a value of peak-to-peak voltage or AC current of the AC voltage to be applied from the AC power source 12 to the charging roller 2. As a current detecting means for measuring (detecting) the value of the DC current flowing from the photosensitive drum 1 to the charging roller 2, the DC current value measuring circuit 14 is provided. From this circuit 14 into the above-described control circuit 13, information on the measured DC current value is input. Further, the control circuit 13 has the function of executing the arithmetic computation and determining program of the DC bias to be applied to the charging roller 2 in the charging process in the image forming step on the basis of the DC current value information input from the DC current value measuring circuit 14.

4. Flow Chart Regarding Control

Figure 5:
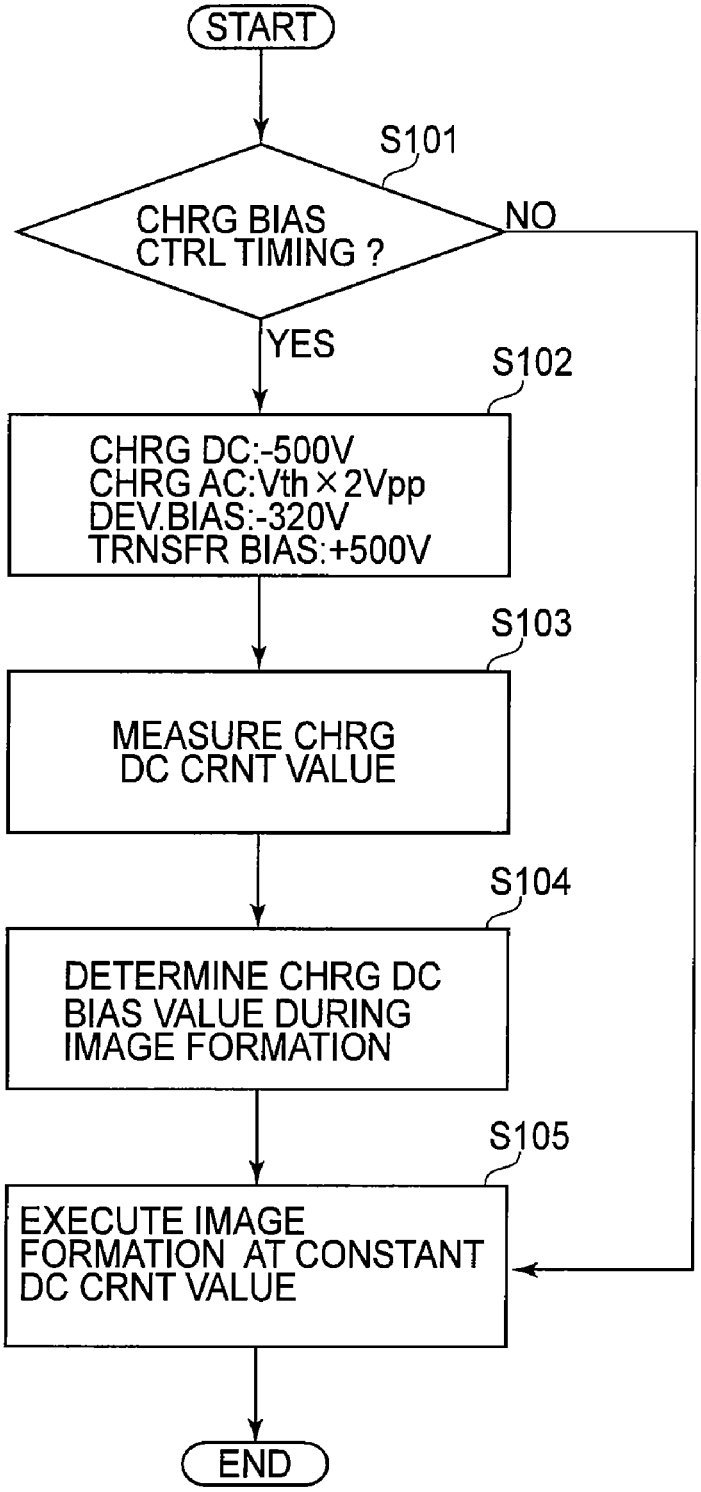
FIG. 5 is a flow chart regarding charge control in Embodiment 1.

Next, a control method of the DC bias to be applied to the charging roller 2 during the printing will be described on the basis of a flow chart. FIG. 5 shows an example of a flow chart of control for determining the charging bias. In this embodiment, the control for determining the charging bias is carried out during non-image formation. In this embodiment, as a value of the charging bias to be applied to the charging roller during the charging bias control, a value equal to that of the charging bias during image formation was used.

Respective steps in the control method will be described specifically below.

The control circuit 13 as the control means controls the respective portions of the image forming apparatus as shown in the flow chart of FIG. 5.

The control circuit 13 as the control means changes processing depending on whether or not the timing of the processing is charging bias control timing. The control circuit 13 performs processing of S102 in the case of the charging bias control timing and performs processing of S105 in the case where the processing timing is not the charging bias control timing (S101).

In S101, in the case where the processing timing is judged as the charging bias control timing, the control circuit 13 sets the charging DC bias at −500 V and sets the peak-to-peak voltage (Vpp) of the charging AC bias at a value two times a discharge start voltage (Vth). Further, the control circuit 13 sets the developing bias at −320 V and sets the transfer bias at +500 V (S102). Here, a bias, for the charging bias control, in the form of the charging DC bias biased with the charging AC bias is referred to as a test bias.

Under a condition set in S102, of values of current flowing between the photosensitive drum and the charging roller, the charging DC current value (DC current component) is measured (S103).

The control circuit determines the value of the charging DC bias to be applied to the charging roller during image formation on the basis of the value of the DC current flowing when the test bias is applied (S104).

In the case where the charging DC bias is determined in S104, image formation is effected on the basis of the determined DC bias. Further, in the case where the processing timing is not the charging bias control timing, the image formation is effected by applying the charging DC bias determined by preceding charging bias control (S105).

Figure 7:
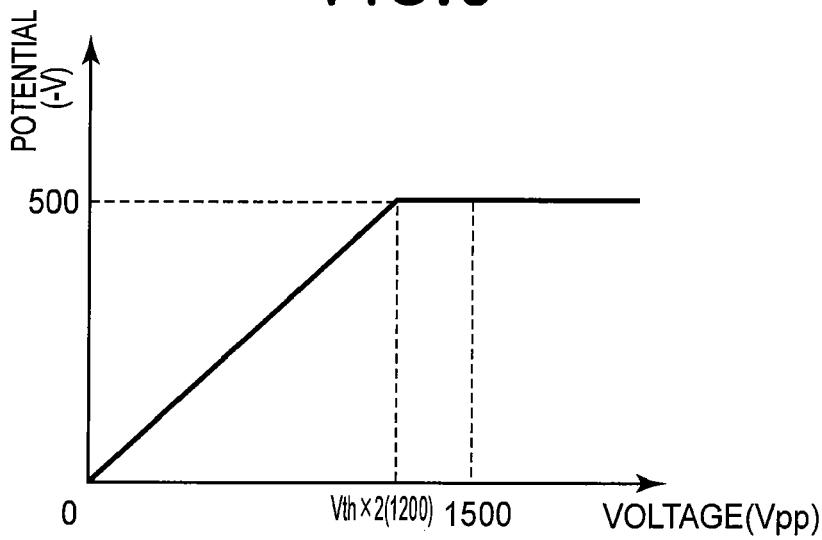
FIG. 7 is a graph showing a relationship between a peak-to-peak voltage and a charge potential in Embodiment 1.
Figure 8:
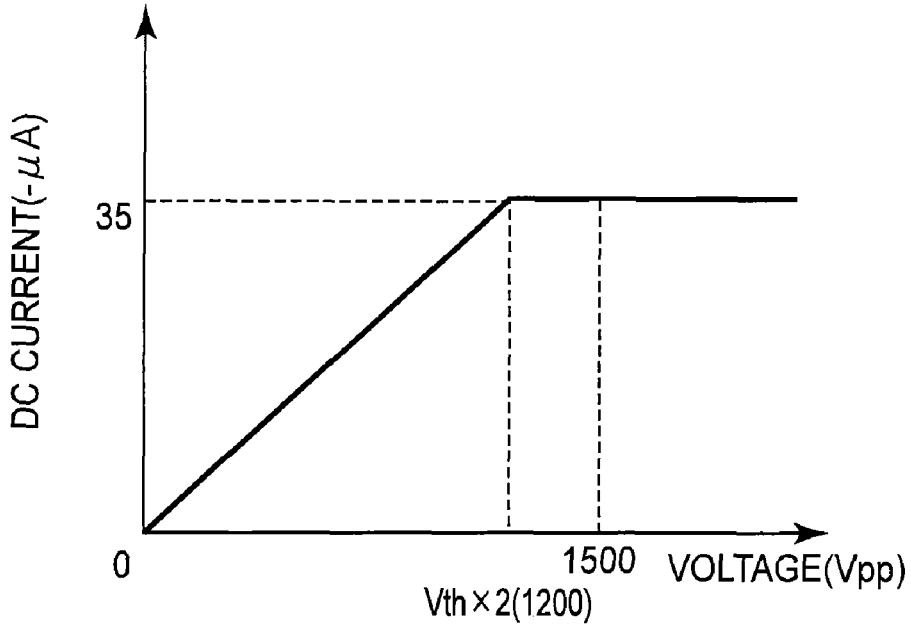
FIG. 8 is a graph showing a relationship between the peak-to-peak voltage and a DC current value in Embodiment 1.

Explanation will be made by using a specific example. In this embodiment, as shown in FIG. 5, the charging DC bias (applied DC voltage) was −500 V, the developing bias was −320 V, and the transfer bias was +500 V. Thus, these biases were set at constant values. Further, as the charging AC bias (applied AC voltage), a peak-to-peak voltage (Vpp) which is not less than two times the discharge start voltage Vth in the DC charging method measured under an environment of, e.g., a temperature of 23° C. and a humidity of 50% RH as shown in FIG. 6 is applied. In FIG. 6, −600 V is Vth. Further, FIG. 7 is a graph showing a relationship between the peak-to-peak voltage of the AC bias and the photosensitive member surface potential under the above condition. A value which is two times Vth was 1200 Vpp and at the peak-to-peak voltage equal to or larger than 1200 Vpp, the photosensitive member surface potential was constant at −500 V. In this embodiment, 1500 Vpp was applied. Further, FIG. 8 is a graph showing a relationship between the peak-to-peak voltage of the AC bias and the DC current value under the above condition. The DC current value during application of DC+AC (during application of the test bias) was constant at the peak-to-peak voltage of not less than 1200 Vpp which is two times Vth. Therefore, in this embodiment, the DC current value of −35 μA which was a constant value even when 1500 Vpp larger than 1200 Vpp was applied was taken as a set charging current value. In the standard environment, Vth is 600 V and the value which is two times Vth is 1200 V. In this embodiment, 1500 Vpp is applied for safety reasons. The discharge current value control may also be effected by providing an AC ammeter for detecting a value of AC current passing between the photosensitive member and the charging roller.

During image formation, i.e., during a normal operation, so-called constant current control in which the applied DC bias is determined by using the DC charging bias as the applied bias and using the DC current value which is set as described above at a constant value of −35 μA was effected.

In this way, by obtaining only one DC current value Ia at the time of the constant charging potential under application of the AC+DC charging bias as the test bias during non-image formation, it was possible to easily obtain the DC current value Ia required only for the DC charging during image formation in which the respective charging conditions are the same condition. Incidentally, in this embodiment, by effecting the constant current control with the DC current value of −35 μA, the photosensitive member surface potential was stabilized at Vd (−500 V) during image formation.

This is because the surface potential of the photosensitive member (photosensitive drum) is determined principally by the DC current component. That is, by applying the test bias in the form of the DC current biased with the AC current, it is possible to detect the DC current component flowing when the charging voltage VD is the applied DC voltage (−500 V). Then, during image formation, the charging bias to be applied to the charging roller may be controlled so as to provide the DC current value detected at the time of the test bias application.

As a result, even in the case where only the DC bias is applied during image formation, the surface potential of the photosensitive drum can be made a desired value without using the potential sensor for measuring the surface potential of the photosensitive drum.

Thus, by effecting the DC charging during image formation, compared with the case of the AC+DC charging, the amount of generation of the discharge product can be decreased. For that reason, even when the continuous image formation is effected, it is possible to decrease a degree of the deterioration of the photosensitive member, such as abrasion of the photosensitive member, for a long term. Further, it is also possible to suppress an occurrence of abnormal image such as image flow caused by the discharge product in a high-temperature and high-humidity environment. Further, there was no need to measure the photosensitive member surface potential with the potential sensor or the like, so that a stable charge potential was able to be set and retained in a space-saving image forming apparatus.

Embodiment 2

In this embodiment, a constitution in which the image forming apparatus was provided with a pre-exposure device was employed.

1. General Structure of Image Forming Apparatus

Figure 9:
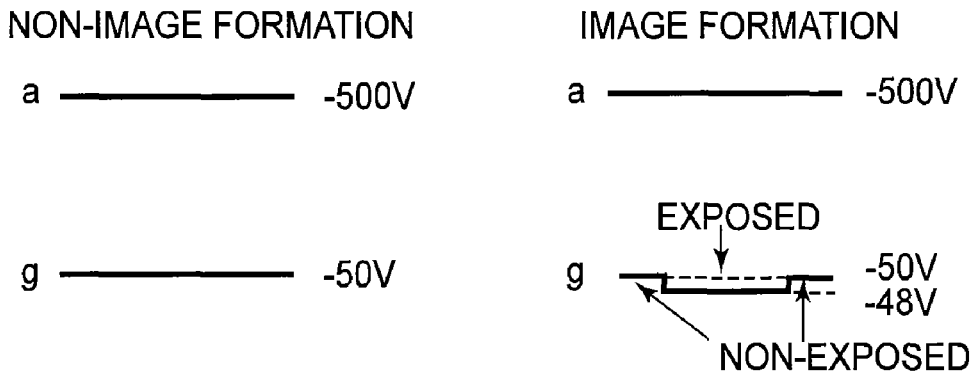
FIG. 9 includes relational views of potentials at a charge portion and a portion immediately before the charge portion in Embodiment 2.

FIG. 9 shows a result of measurement of the photosensitive member surface potential at the charged portion a (FIG. 1) and the portion (position) g immediately before the charging portion (FIG. 1) during non-image formation and during image formation. As shown in FIG. 9, in the case of during non-image formation (with no exposure), the photosensitive member surface potential after the transfer is flat. However, in the case of image formation (with exposure), the photosensitive member surface potential after the transfer caused a slight potential difference of 2 V in this embodiment at the exposed portion compared with the non-exposed portion in some instances.

In this embodiment, the photosensitive member surface is charged to the negative polarity and positive electric charges are generated inside the photosensitive member by the exposure, so that the surface potential is cancelled to form the electrostatic latent image. However, in some cases, the positive electric charges in the photosensitive member cannot be cancelled depending on a material of the photosensitive drum, an exposure amount, or the like to result in a positive memory. In the case where this memory was not uniformized at the transfer portion, at the portion g immediately before the charging portion, the potential difference between the exposed portion and the non-exposed portion (hereinafter referred to as a ghost potential) was caused to occur.

Thus, during image formation and during non-image formation, when the difference in potential between the charging portion a and the portion g immediately before the charging portion is caused to occur, even under application during image formation of the charging DC current value Ia obtained during non-image formation as in Embodiment 1, a slight error in charge potential was caused to occur.

Figure 10:
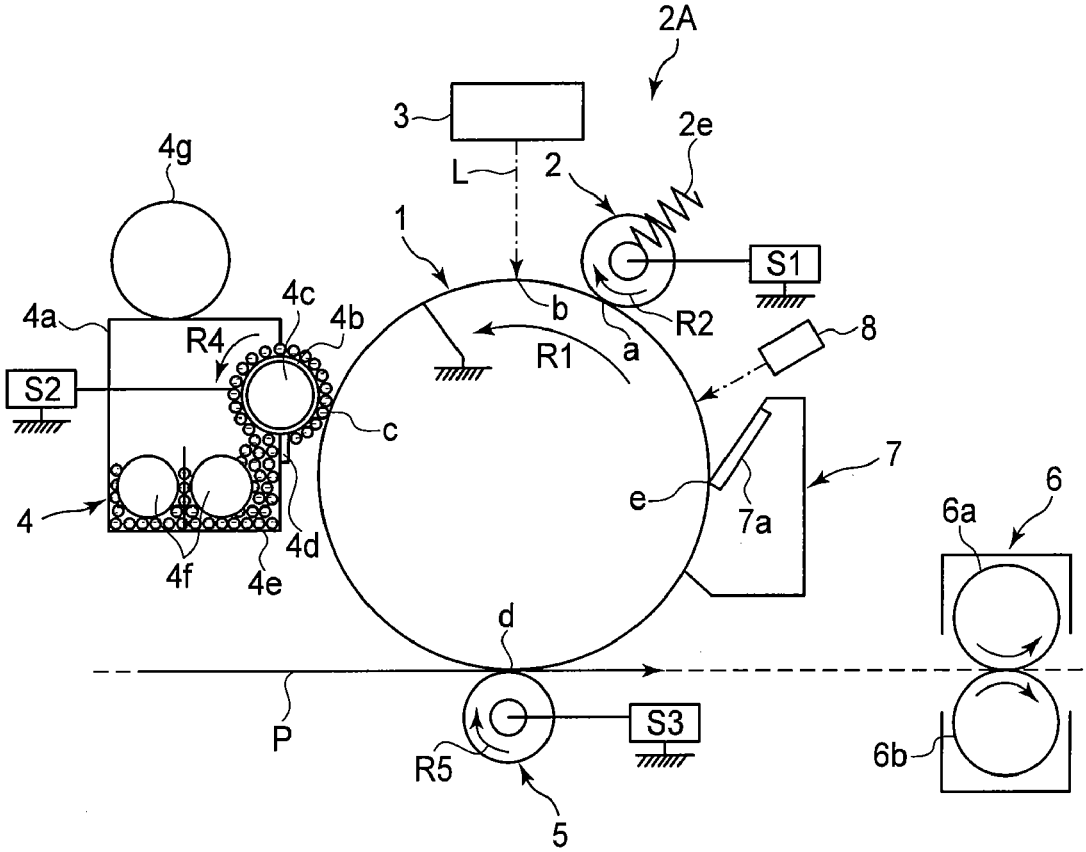
FIG. 10 is a schematic structural view of an image forming apparatus in Embodiment 2.

In view of this problem, in this embodiment, as shown in FIG. 10, a pre-exposure device 8 was provided between the transfer portion d and charging portion a of the photosensitive drum 1. Even when the ghost potential is caused to occur after the transfer, the longitudinal surface of the photosensitive drum is uniformly exposed to light again by the pre-exposure device 8, so that the ghost potential can be uniformly leveled off.

2. Flow Chart Regarding Control

Figure 11:
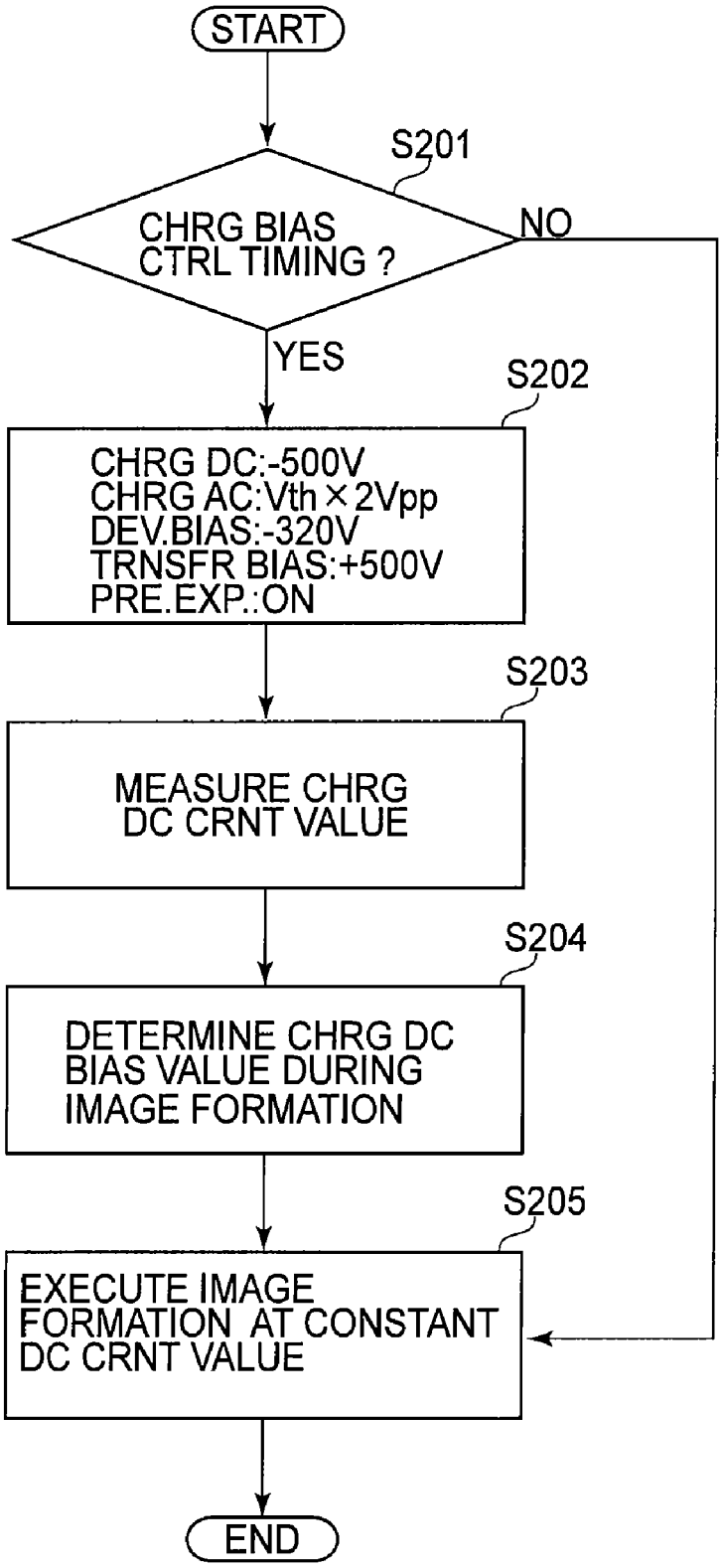
FIG. 11 is a flow chart regarding charge control in Embodiment 2.

FIG. 11 shows an example of a flow chart of charging bias control during non-image formation. Similarly as Embodiment 1, the control circuit as the control means controls the respective portions of the image forming apparatus as shown in the flow chart. The control circuit executes the following processing of S202 to processing of S204 with charging bias control timing. The control circuit determines whether or not the charging bias control should be effected in S201. The control circuit performs the processing of S202 in the case of the charging bias control timing and performs processing of S205 in the case where the processing timing is not the charging bias control timing.

In the case of the charging bias control timing, the control circuit sets the charging DC bias at −500 V and sets the charging AC bias at a value two times the discharge start voltage value (Vth). Further, the control circuit sets the developing bias at −320 V and sets the transfer bias at +500 V to effect the pre-exposure (S202). In the case of the charging bias control timing, as shown in S202, the DC bias is superposed with the AC bias (test bias). Of values of current flowing at the time of applying the test bias, a value of DC current is measured (S203). The control circuit determines the value of the charging DC bias on the basis of the value of the DC current flowing when the test bias is applied, measured in S203 (S204).

In the case where the charging DC bias is determined in S204, image formation is effected on the basis of the determined DC bias. Further, in the case where the processing timing is not the charging bias control timing, the image formation is effected by applying the charging DC bias determined by preceding charging bias control (S205).

Figure 12:
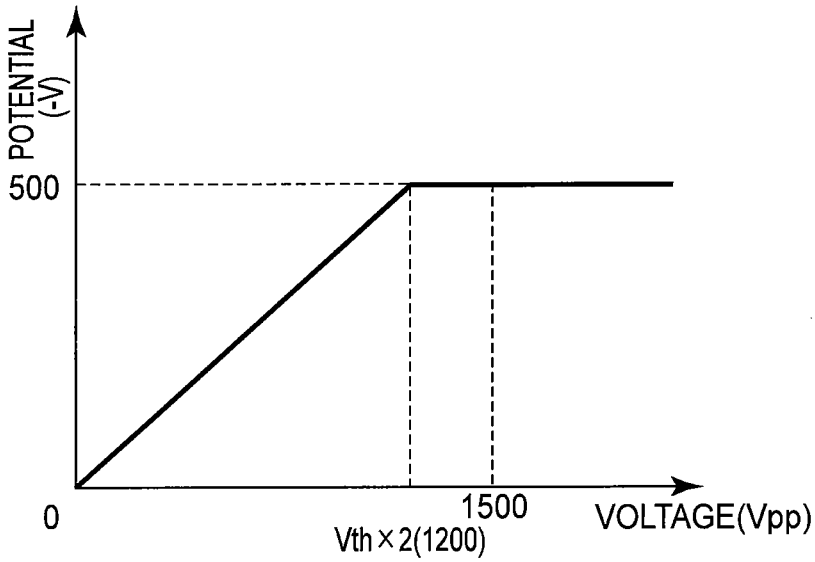
FIG. 12 is a graph showing a relationship between a peak-to-peak voltage and a charge potential in Embodiment 2.
Figure 13:
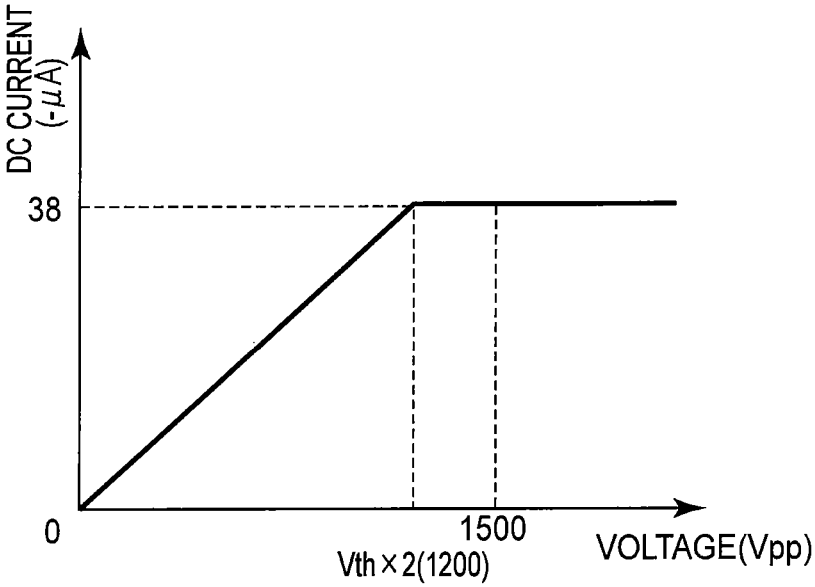
FIG. 13 is a graph showing a relationship between the peak-to-peak voltage and a DC current value in Embodiment 2.

Explanation will be made by using a specific example. The bias condition and the operation condition during non-image formation were identical to those during image formation. In this embodiment, as shown in FIG. 11, the charging DC bias was −500 V, the developing bias was −320 V, and the transfer bias was +500 V. Thus, these biases were set at constant values. Further, the pre-exposure is performed ("ON"). Further, as the charging AC bias, a peak-to-peak voltage (Vpp) which is not less than two times the discharge start voltage Vth in the DC charging method measured under an environment of, e.g., a temperature of 23° C. and a humidity of 50% RH as shown in FIG. 6 is applied. In FIG. 6, −600 V is Vth. Further, FIG. 12 is a graph showing a relationship between the peak-to-peak voltage of the AC bias and the photosensitive member surface potential under the above condition. A value which is two times Vth was 1200 Vpp and at the peak-to-peak voltage equal to or larger than 1200 Vpp, the photosensitive member surface potential was constant at −500 V. In this embodiment, 1500 Vpp was applied. Further, FIG. 13 is a graph showing a relationship between the peak-to-peak voltage of the AC bias and the DC current value under the above condition. The DC current value during application of DC+AC (i.e., during application of the test bias) was constant at the peak-to-peak voltage of not less than 1200 Vpp which is two times Vth. Therefore, in this embodiment, the DC current value of −38 μA which was a constant value even when 1500 Vpp larger than 1200 Vpp was applied was taken as a set charging current value.

During image formation, so-called constant current control in which the applied DC bias is determined by using the DC charging bias as the applied bias and using the DC current value which is set as described above at a constant value of −38 μA was effected.

In this way, by performing the pre-exposure, even in the case where the ghost potential was caused to occur due to variations in the photosensitive member material, the exposure amount, and the like, a necessary charging DC current value during image formation was able to be obtained easily.

Embodiment 3

In Embodiments 1 and 2, the case where the photosensitive member surface potential during image formation and the photosensitive member surface potential during the control during non-image formation were equal to each other was described.

Figure 14:
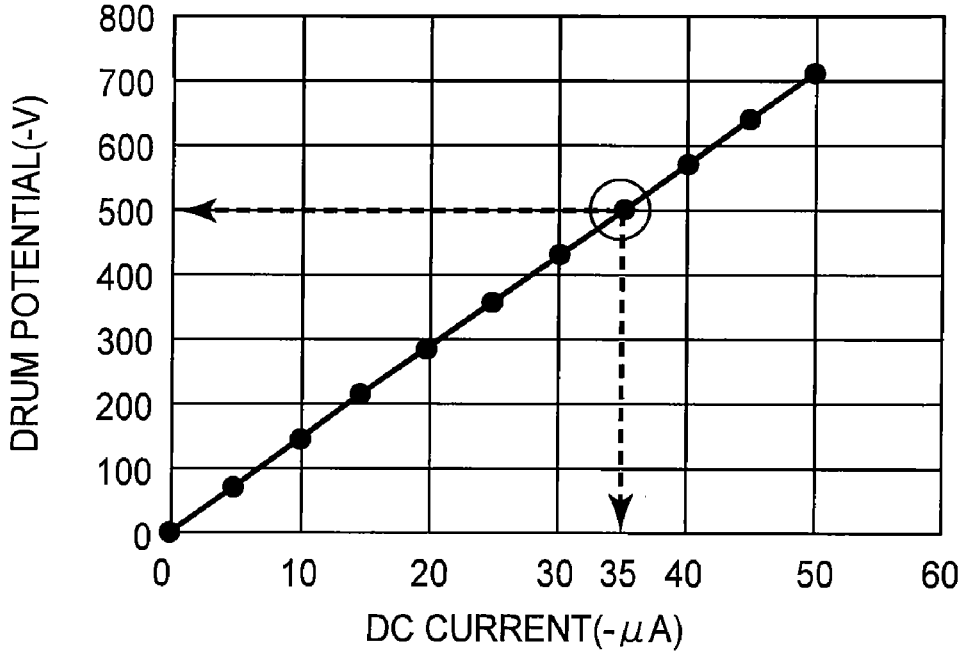
FIG. 14 is a graph showing a relationship between a DC current value and a photosensitive member surface potential in Embodiment 3.

FIG. 14 is a graph showing a relationship between the charging DC current value and the photosensitive member surface potential. The relationship between the charging DC current value and the photosensitive member surface potential is a direct proportional relationship, so that when the charging DC current value of −35 μA at one point, e.g., at the photosensitive member surface potential of −500 V in this embodiment can be measured, it is also possible to set the charging DC current value required for a desired photosensitive member surface potential in accordance with the following equation:

[photosensitive member surface potential]=(500/35)×[charging DC current value].

In this way, the charging DC current value in a range in which a predetermined photosensitive member surface potential is stabilized is obtained by the DC+AC charging method at only one point during non-image formation, and from the charging DC current value and the predetermined photosensitive member surface potential, it is also possible to calculate a charging DC current value (I) necessary to be set for another photosensitive member surface potential. That is, when the DC current value under application of the AC voltage during non-image formation is Ia, the DC voltage value providing the DC current value Ia is Va, and the DC voltage value and DC current value for obtaining the photosensitive member surface potential required during image formation are V and I, respectively, the following equation is satisfied:

Charging DC voltage value (V)=(Va/Ia)×charging DC current value (I), that is, I=(V/Va)×Ia.

Here, when a ratio (V/Va) between the DC voltage Va applied during the control during non-image formation and the DC voltage V applied during image formation is calculated, this ratio is represented by a predetermined constant D.

That is, during image formation, by effecting the constant current control so that the DC current value is Ia×D, the photosensitive member surface potential can be set at a desired potential V.

Embodiment 4

Figure 15:
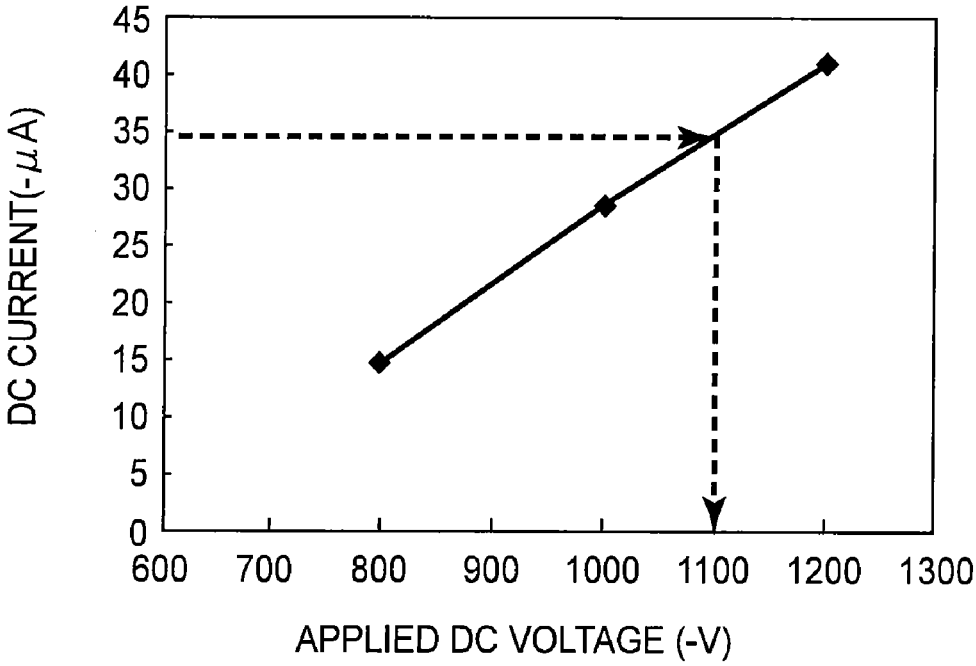
FIG. 15 is a graph showing a relationship between an applied DC voltage value and a DC current value in Embodiment 4.

FIG. 15 is a graph showing a change in DC current value when the DC voltage applied from the power source S1 (FIG. 1) is increased or decreased at several levels. When the necessary DC current value Ia is obtained from the relationship between the DC voltage and the DC current, it is also possible to obtain the necessary applied DC voltage Va from the graph of FIG. 15.

For example, in this embodiment, when the necessary DC current Ia was −35 μA, the necessary applied DC voltage Va was −1100 V. By subjecting this DC voltage Va to the constant voltage control and applying the DC voltage Va during image formation, it is also possible to keep the charge potential at a portion potential (level).

However, when the relationship between the DC voltage and the DC current as shown in FIG. 15 is obtained, in the developing device, there is a possibility of an occurrence of a problem such as carrier deposition or fog during the control. Therefore, as described in Embodiment 1, the control may desirably be made at the constant current.

Incidentally, in this embodiment (Embodiment 4), the case where the photosensitive member surface potential during image formation is identical to the photosensitive member surface potential during the control during non-image formation is described above. However, the following modified embodiment may also be employed.

As is understood from FIG. 15, when the predetermined AC voltage is applied during the control during non-image formation to obtain the charging DC current value Ia and the applied DC voltage at the time is Va, the ratio (V/Va) between the DC voltage Va and the DC voltage value V applied during image formation is the predetermined constant D.

That is, during image formation, by effecting the constant current control so that the DC voltage value is Va×D, the photosensitive member surface potential can be set at a desired potential (level).

In the above embodiment, the execution period of the arithmetic computation and determination program for an appropriate applied DC current value in the charging process of the printing step in the preparatory rotation operation period for printing corresponding to during non-image formation of the printer is not limited to the preparatory rotation operation period for printing as in the case of the printer in the above embodiment. The program can also be executed during other non-image forming operations, i.e., during initial rotation operation, during sheet interval step, and during post-rotation operation and can also be executed during a plurality of non-image forming operations. Further, in the above embodiment, the pre-exposure device is taken as an example in order to obviate the ghost potential but as another device other than the pre-exposure device, a discharging (charge-removing) device for applying a bias onto the photosensitive member after the bias application by the transfer device may also be used.

In Embodiment 4, the DC voltage value providing the constant DC current value is obtained by using the several DC voltage values which are increased or decreased but it is also possible to effect the constant voltage control by once effecting the constant current control so as to provide the DC current value and then by reading the DC voltage value at the time of the constant current control. Further, the image forming apparatus using the cleaning (cleaner) member is used as an example but it is also possible to achieve a similar effect with respect to the charge control means in the image forming apparatus using a so-called cleaner-less system in which the cleaning member is not provided and simultaneous development and cleaning is effected by the developing device.

In the above-described respective embodiments, the constitution in which the charging roller is used as a flexible contact charging member is employed but as another flexible contact charging member, it is possible to use those having a shape or material such as a fur brush, a felt, and cloth. Further, by combining various materials, it is possible to obtain those having proper elasticity, electroconductivity, surface property, and durability.

As a waveform of the AC voltage component (AC component; voltage periodically changed in voltage value) of the oscillating electric field applied to the charging roller 2 and the developing sleeve **4*b* in the above-described embodiments, it is possible to appropriately use a sinusoidal wave, a rectangular wave, a triangular wave, and the like. Further, a rectangular wave formed by turning the DC power source on and off periodically may also be used. Further, a method in which the power source is common to the oscillating electric fields applied to the charging roller and the developing sleeve and pulse-width modulation is performed to divide the frequency and the waveform between the oscillating electric fields for charging and development is effective means from the standpoint of cost. Further, in the above-described embodiments, the exposure device which is the laser scanning means as the exposure means (information writing means) and the pre-exposure means with respect to the charge surface of the photosensitive drum 1** is used but it is also possible to use a digital exposure means using a solid light-emitting element such as LED. Further, an analog-like image exposure means using a halogen lamp, a fluorescent lamp, or the like as an original illumination light source may also be used. Further, in the above-described embodiments, roller transfer using the transfer roller as the transfer means is performed but it is also possible to employ other contact transfer charging methods such as blade transfer and belt transfer and a non-contact transfer charging method using a corona charger. Further, in the above-described embodiments, the image forming apparatus in which the single color (monochromatic) toner image formed on the photosensitive drum was directly transferred onto the transfer material was used. However, the present invention is also applicable to an image forming apparatus in which not only the single color image but also a multi-color or full-color image is formed through multi-transfer or the like by using an intermediary transfer member such as a transfer drum or a transfer belt.

Embodiment 5

Hereinbelow, a constitution for achieving commonality in the AC power source in the image forming apparatus will be described. In this embodiment, such a constitution that a Bk station for forming an image with a black (Bk) toner is not provided with the AC power source but color stations (Y, M and C) are provided with the AC power source is employed. In this constitution, when the charging DC bias for the Bk station is determined, the AC power source for the color stations is used by using a switch. The AC power source may also be a single AC power source for all the color stations. Further, the AC power source may be common to not only those for charging but also those for development. Hereinbelow, a general structure will be described and then charging bias control will be described along a flow chart.

1. General Structure of Image Forming Apparatus

Figure 18:
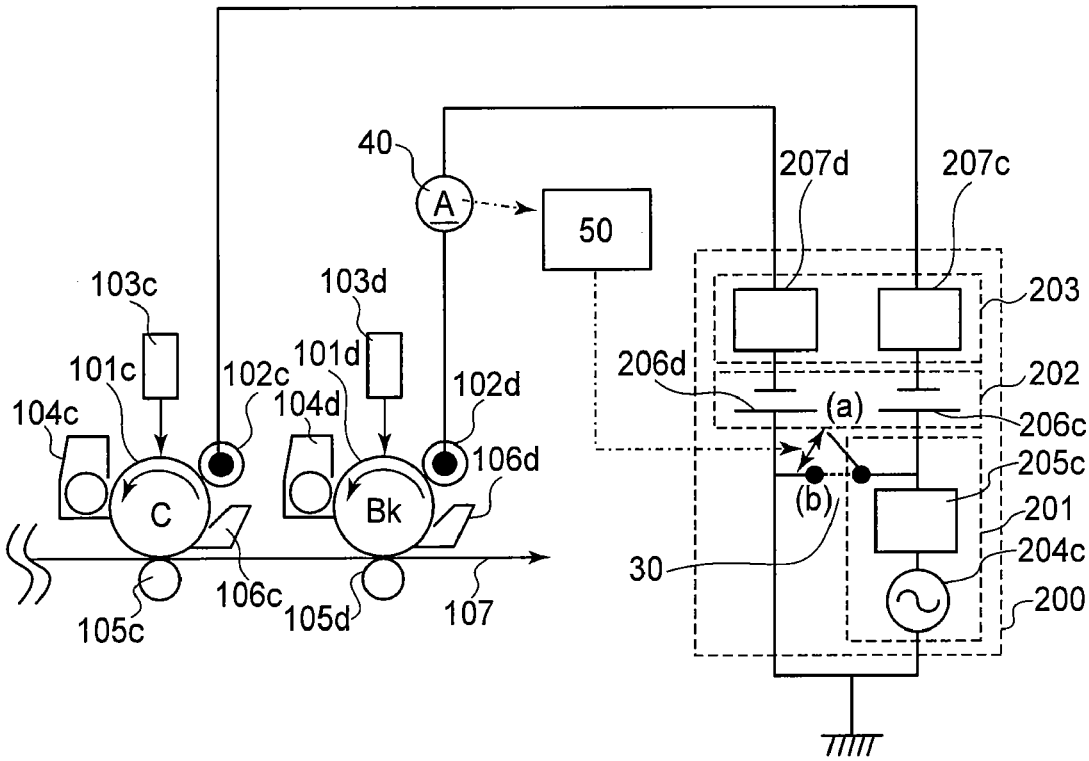
FIG. 18 is a schematic structural view of an image forming apparatus in Embodiment 5.

FIG. 18 is a schematic structural view showing an example of a full-color image forming apparatus. This image forming apparatus includes four stations consisting of an image forming portion Y for forming a yellow image, an image forming portion M for forming a magenta image, an image forming portion C for forming a cyan image, and an image forming portion Bk. These four image forming portions (stations) are disposed in a line with regular intervals (so-called a tandem-type image forming apparatus). Here, explanation will be made by paying attention to the C (cyan) and Bk (black) stations.

At the image forming portions C and Bk, photosensitive drums 101*c* and 101*d* are disposed, respectively. Around the photosensitive drums 101*c* and 101*d*, charging rollers 102*c* and 102*d*, exposure devices 103*c* and 103*d*, developing devices 104*c* and 104*d*, transfer rollers 105*c* and 105*d*, and drum cleaning devices 106*c* and 106*d* are disposed, respectively. In the developing devices 104*c* and 104*d*, the cyan toner and the black toner are accommodated, respectively.

In a full-color image forming method with respect to the recording material by the above-described image forming apparatus, the color toner images formed on the photosensitive drums 101*c* and 101*d*, respectively, by an electrophotographic process are successively transferred onto an intermediary transfer belt 107 by the respective transfer rollers. Thereafter, the toner images are transferred onto the recording material by an unshown secondary transfer device and are fixed on the recording material by an unshown fixing device. To the charging rollers 102*c* and 102*d*, a charging bias is applied from a high-voltage power supply circuit (charging bias power source) 200, so that the surfaces of the photosensitive drums 101*c* and 101*d* are charged uniformly to a predetermined potential. The high-voltage power supply circuit 200 generates a bias by using an AC voltage circuit 201, a DC voltage generating circuit 202, and a DC voltage amplifying circuit 203 in combination.

In this embodiment, at the color stations and the black station, based on a use frequency relationship, the power source for color and the power source for black are separately used. In the above-described full-color image forming apparatus, there are the case of outputting the full-color image and the case of outputting the image of Bk (single color). In the market, an output ratio of the full-color to the Bk (single color) was 1:5, so that the use frequency of the Bk station was larger.

In such a case, when the full-color image is formed, the photosensitive drum at each of the stations is similarly subjected to the charging, so that a difference in lifetime between the photosensitive drum at each color station and the photosensitive drum at the black station is increased. That is, in a Bk (single color) mode, the charging is not performed at the color stations, so that only an abrasion amount of the photosensitive drum at the Bk station is increased.

Therefore, in this embodiment, in order to reduce the difference in abrasion amount between the use frequencies of the photosensitive drums in the full-color mode and the Bk (single color) mode, during image formation, the charging roller at each of the color stations is subjected to the AC+DC charging and the charging roller at the Bk station is subjected to the DC charging.

In FIG. 18, the DC voltage to be applied to the charging roller 102*c* at the C station is applied by a DC voltage generating circuit 206*c* in the DC voltage generating circuit 202. A magnitude of the DC voltage value is adjusted by a DC voltage amplifying circuit 207*c* in the DC voltage amplifying circuit 203. Further, the AC voltage to be applied to the charging roller 102*c* is applied by an AC voltage generating circuit 204*c* in the AC voltage circuit 201. A magnitude of the AC voltage value is adjusted by an AC voltage amplifying circuit 205*c* in the AC voltage circuit 201.

Further, the DC voltage to be applied to the charging roller 102*d* at the Bk station is applied by a DC voltage generating circuit 206*d* in the DC voltage generating circuit 202. A magnitude of the DC voltage value is adjusted by a DC voltage amplifying circuit 207*d* in the DC voltage amplifying circuit 203. A reference numeral 30 represents a switch for superposing the AC voltage from the AC voltage circuit 201 for the C station on the DC voltage applied by the DC voltage generating circuit for the Bk station. When the switch 30 is located at a position (a), the AC voltage to be applied to the Bk station is not applied (OFF). When the switch 30 is located at a position (b), the AC voltage to be applied to the Bk station is applied (ON).

A control circuit 50 has the function of controlling the power source 200 so that the charging rollers 102*c* and 102*d* are supplied with the DC voltage or the oscillating (superposed) voltage in the form of the DC voltage biased with the AC voltage by effecting ON/OFF control of the power source 200. The control circuit 50 further has the function of controlling a value of the DC voltage to be applied to the charging roller 102*d* and a value of peak-to-peak voltage or AC current of the AC voltage to be applied to the charging roller 102*d*. As a means for measuring the value of the DC current flowing from the photosensitive drum 101*d* to the charging roller 102*d*, a DC current value measuring circuit 50 is provided. From this circuit 40 into the above-described control circuit 50, information on the measured DC current value is input. Further, the control circuit 40 has the function of executing the arithmetic computation and determining program of the DC bias to be applied to the charging roller 102 in the charging process in the image forming step on the basis of the DC current value information input from the DC current value measuring circuit 40.

2. Flow Chart Regarding Control During Power Source Commonalty

Figure 19:
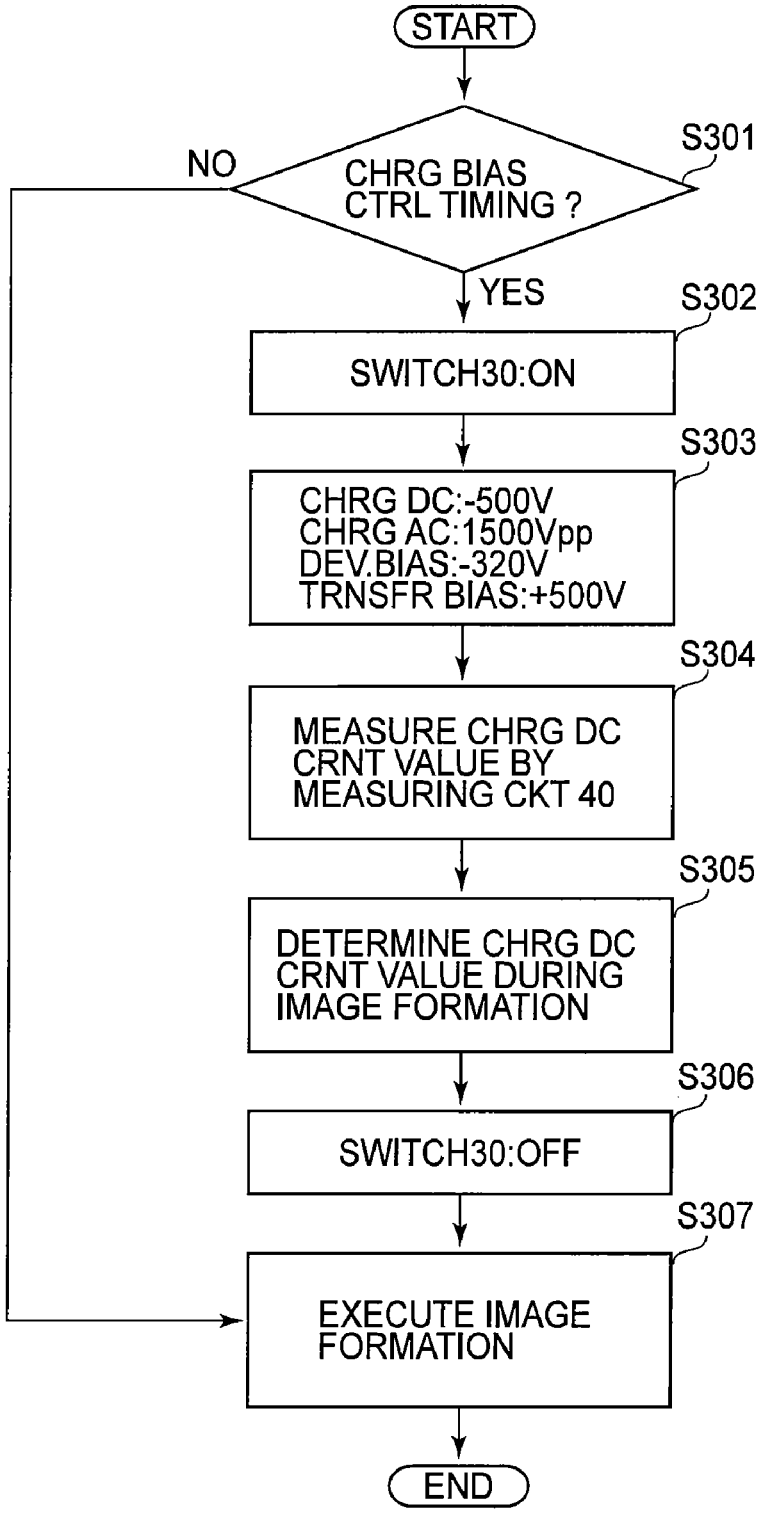
FIG. 19 is a flow chart regarding charge control in Embodiment 5.

Next, a control method of the DC bias applied to the charging roller 102*d* during the printing will be described. FIG. 19 is an example of a flow chart of charging bias control during non-image formation. Along the flow chart, a procedure for controlling the respective image forming portions by the control circuit will be described below.

The control circuit 50 judges whether or not processing timing is charging bias control timing (S301). In the case of the charging bias control timing, the control circuit 50 executes processing of S302 and in the case where the processing timing is not the charging bias control timing, the control circuit executes processing of S307.

When the processing timing is the charging bias control timing (during non-image formation), the control circuit 50 turns the switch 30 on. That is, in FIG. 18, the switch 30 is moved to the position (b) (S302).

Next, at the Bk station, a transfer and developing bias condition is made identical in value to that during image formation and in order that the charge potential value is equal to that during image formation, the charging bias including the applied DC voltage value equal to the charge potential value and the peak-to-peak voltage as the applied AC voltage value which is not less than two times Vth is applied. As the charging AC bias, the peak-to-peak voltage (Vpp) which is not less than two times the discharge start voltage Vth in the DC charging method measured under an environment of, e.g., a temperature of 23° C. and a humidity of 50% RH as shown in FIG. 6 is applied. In FIG. 6, −600 V is Vth. Further, FIG. 7 is a graph showing a relationship between the peak-to-peak voltage of the AC bias and the photosensitive member surface potential under the above condition. A value which is two times Vth was 1200 Vpp and at the peak-to-peak voltage equal to or larger than 1200 Vpp, the photosensitive member surface potential was constant at −500 V. In this embodiment, the AC bias of 1500 Vpp was applied to the charging roller 102*d*. Further, the DC bias of −500 V was applied. Further, at the Bk station, the developing bias was constant at −320 V and the transfer bias was constant at +500 V (S303). Thus, at the Bk station, the test bias in the form of the DC bias superposed with the AC bias supplied from the AC power source for the C station is applied to the charging roller.

The DC current passing through the charging roller 102*d* at the time when the test bias is applied to the charging roller is measured by the DC current value measuring circuit 40 (S304). In this embodiment, the measured DC current value was −35 μA. The current value is determined as the DC current value during image formation (S305). The control circuit 50 turns the switch 30 off. That is, in FIG. 18, the switch 30 is returned to the position (a) (S306). Then, the procedure went to the image forming operation (S307). When the processing timing is not the charging bias control timing in S301, the procedure went to the image forming operation as it was (S307).

Thus, at the charging bias control timing, a necessary DC current value is determined by the AC bias from another station and by effecting the DC charging during image formation, compared with the case of the AC+DC charging, the amount of generation of the discharge product can be decreased. As a result, even when the continuous image formation is effected, it is possible to decrease a degree of the deterioration of the photosensitive member, such as abrasion of the photosensitive member, for a long term. Further, it is also possible to suppress an occurrence of abnormal image such as image flow caused by the discharge product in a high-temperature and high-humidity environment. Further, there is no need to measure the photosensitive member surface potential with the potential sensor or the like, so that a stable charge potential is able to be set and retained in a space-saving image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 064985/2009 filed Mar. 17, 2009, which is hereby incorporated by reference.

What is claimed is:

1. An image forming apparatus comprising:

a rotatable photosensitive member;

a charging device configured to charge said photosensitive member by being supplied with a charging bias;

a detecting device configured to detect a DC current flowing between said photosensitive member and said charging device;

an executing device configured to execute an operation in a test mode in which a test bias is applied to said charging device, the test bias being in the form of a DC voltage biased with an AC voltage having a peak to peak voltage which is at least two times a discharge start voltage; and a control device configured to apply only a DC voltage to said charging device during image formation and to control the DC voltage applied to said charging device during image formation on the basis of a value of the DC current detected by said detecting device during execution of the operation in the test mode.

2. An image forming apparatus comprising:

a photosensitive member;

a charging device configured to charge said photosensitive member by being supplied with a charging bias;

a DC power source for applying a DC bias to said charging device;

an AC power source for applying an AC bias to said charging device;

a detecting device configured to detect a value of a DC current flowing between said photosensitive member and said charging device; and a control device configured to control, during image formation, the charging bias so that said photosensitive member is charged by applying only the DC bias from said DC power source to said charging device, wherein said control device applies a test bias to said charging device during non-image formation, the test bias being in the form of a predetermined DC voltage, applied from said DC power source, biased with a predetermined AC voltage having a peak to peak voltage which is at least two times a discharge start voltage with respect to said photosensitive member when a DC voltage is applied to said charging device and which is applied from said AC power source, and wherein said control device controls, during the image formation, the DC bias applied to the charging device on the basis of a value of the DC current detected by said detecting device when the test bias is applied.

3. An image forming apparatus according to claim 2, wherein the DC voltage of the test bias is equal to a surface potential of said photosensitive member during the image formation, and wherein said control device controls, during the image formation, the DC bias applied to said charging device so that the same current as the DC current detected by said detecting device flows from said DC power source when the test bias is applied.

4. An image forming apparatus according to claim 2, wherein the DC voltage of the test bias is a predetermined multiple of a surface potential of said photosensitive member required during the image formation, and wherein said control device controls, during the image formation, the DC bias applied to said charging device so that the DC current detected by said detecting device when the test bias is applied is the predetermined multiple of a current flowing from said DC power source during the image formation.

* * * * *